United States Patent [19]

Blakely et al.

[11] 4,448,103

[45] May 15, 1984

[54] TUNABLE BASS-TONE DEVICE

[76] Inventors: Bill W. Blakely, 553 NW. Sweetbriar; Robert Reece, 1423 SE. Lane St., both of Roseburg, Oreg. 97470

[21] Appl. No.: 317,255

[22] Filed: Nov. 2, 1981

[51] Int. Cl.[3] ..... G10H 1/36; G10H 5/06

[52] U.S. Cl. ..... 84/1.01; 84/453; 84/DIG. 3; 84/DIG. 22

[58] Field of Search ..... 84/1.01, 443, 453, DIG. 12, 84/DIG. 22, DIG. 3, DIG. 17

[56] References Cited

U.S. PATENT DOCUMENTS

| | | | |
|---|---|---|---|
| 274,464 | 3/1883 | Clifford et al. | 84/443 |
| 316,908 | 4/1885 | O'Neill | 84/443 |
| 1,234,814 | 7/1917 | Standridge | 84/443 |
| 1,300,878 | 4/1919 | Reynolds | 84/443 |
| 2,779,225 | 1/1957 | Carlson | 84/453 X |
| 3,060,784 | 10/1962 | Holt | 84/423 |
| 3,068,334 | 12/1962 | Gibbs et al. | 200/166 |
| 3,095,465 | 6/1963 | Holman | 84/1.01 |
| 3,671,658 | 6/1972 | Ohno | 84/1.01 |
| 4,124,313 | 11/1978 | Schmidt et al. | 400/491.2 |
| 4,294,155 | 10/1981 | Turner | 84/1.01 |
| 4,380,947 | 4/1983 | Nishimoto | 84/DIG. 3 |

*Primary Examiner*—Stanley J. Witkowski
*Attorney, Agent, or Firm*—Armstrong, Nikaido, Marmelstein & Kubovcik

[57] ABSTRACT

The present invention is directed to a bass-tone device for use with a piano. The device comprises a housing which can be mounted on a piano above the keyboard of the piano. A plurality of switches are mounted in the housing, and each of the switches has an engaging portion which extends from the housing and contacts a key of the piano when the key is in its normal undepressed state. The engaging portion of each of these switches moves to change the state of the switch in response to the depressing of the corresponding piano key. A bass-tone generator is mounted in the housing and the switches are connected to the generator. The bass-tone generator generates bass-tone signals in response to the change of state of the switches, which change states in accordance with the depression or raising of the piano keys.

5 Claims, 3 Drawing Figures

TUNABLE BASS-TONE DEVICE

BACKGROUND OF THE INVENTION

1. Field of the Invention

The present invention is directed to a bass-tone device for use with a piano and, more particularly, to a bass-tone device which is tunable and which is self-contained and can be easily attached to a piano and operates in response to the actuation of the piano keys.

2. Description of the Prior Art

Prior art bass-tone devices such as that manufactured by Fender-Rhodes or other prior art electronic musical instruments such as that shown in Ohno, U.S. Pat. No. 3,371,658, are devices which have their own keyboard. Thus, these instruments must be played using at least one hand of the musician. Furthermore, many prior-art devices are bulky and heavy and must be used as a separate and distinct instrument when played in conjunction with a piano.

SUMMARY OF THE INVENTION

It is the primary object of the present invention to provide a bass-tone device which is attached to a piano and which operates in response to the operation of the piano keys.

It is still a further object of the present invention to provide a bass-tone device which can be tuned for operation in conjunction with any piano.

It is another object of the present invention to provide a bass-tone device which can be simply mounted on any piano.

The present invention is directed to a bass-tone device for use with a piano. The device comprises a housing which can be mounted on a piano above the keyboard of the piano. A plurality of switches are mounted in the housing, and each of the switches has an enagaging portion which extends from the housing and contacts a key of the piano when the key is in its normal undepressed state. The engaging portion of each of these switches moves to change the state of the switch in response to the depressing of the corresponding piano key. A bass-tone generator is mounted in the housing and the switches are connected to the generator. The bass-tone generator generates bass-tone signals in response to the change of state of the switches, which change states in accordance with the depression or raising of the piano keys.

A further feature of the present invention is that the engaging portion of each of the switches comprises a pin member which extends from the housing and contacts the top surface of the piano key, which is positioned thereunder. Upon depression of the piano key, the pin member moves down, maintaining contact with the key for at least a portion of the downward movement thereof, and the downward movement of the pin member changes the state of the contacts of a switch. This results in the generation of a corresponding bass-tone.

A further feature of the present invention is that the tone generator includes a tuning means which changes the pitch of a particular tone of the bass-tone generator. This feature enables the device to be tuned to a particular piano upon which it is mounted.

DETAILED DESCRIPTION OF THE PREFERRED EMBODIMENTS

Figure 1:
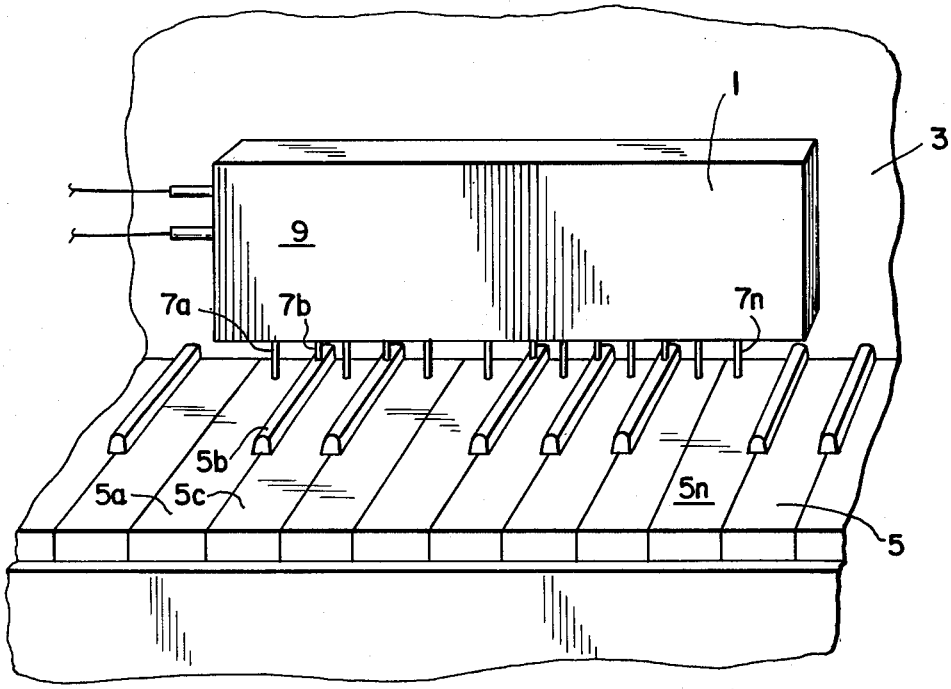
FIG. 1 illustrates a bass-tone device of the present invention mounted on a piano.

Referring to FIG. 1, a bass-tone device 1 is mounted on piano 3 above the keyboard 5. Engaging portions 7*a*–7*n* of switches within the housing 9 of the bass-tone device 1 are pin members which extend downward and engage keys 5*a*–5*n* of the piano keyboard.

Figure 2:
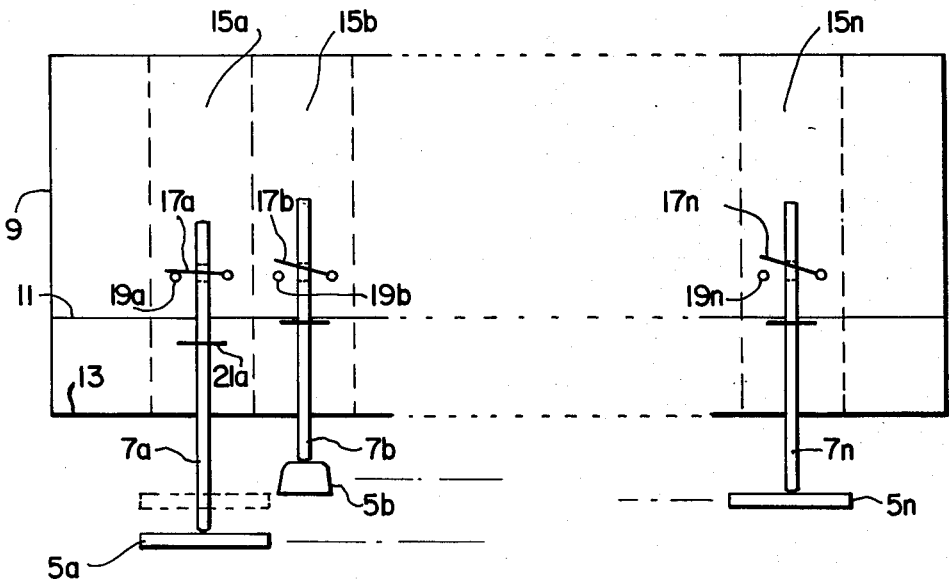
FIG. 2 illustrates a switch for use in conjunction with the bass-tone device of the present invention.

Referring to FIG. 2, the housing 9 has two plates 11 and 13 which extend thereacross in the horizontal direction. Engaging portions 7*a*–7*n* of the switches 15*a*–15*n* extend downward outside of the housing 9 through holes in members 11 and 13. Each of the switches 15*a*–15*n* include a first contact 17*a*–17*n* and a second contact 19*a*–19*n*. The contacts 17*a*–17*n* pass through a hole in engaging portions 7*a*–7*n* so that as the engaging portions 7*a*–7*n* are moved upward and downward, the corresponding contacts 17*a*–17*n* move up and down, thereby making and breaking contact with switch contacts 19*a*–19*n*. Key 5*a* of the piano keyboard 5 is shown in a depressed condition and, in this condition, the engaging portion 7*a* of switch 15*a* will move downward under the force of gravity, bringing contact 17*a* into contact with contact 19*a*. Switch 15*b* shows a key 5*b* in a nondepressed state and, in this position, the key 5*b* contacts the bottom of engaging portions 7*b* pushing it upward, whereby contacts 17*b* and 19*b* are held apart. Stops 21*a*–21*n* control the maximum upward movement of the engaging portions 7*a*–7*n*.

Thus, it can be seen that when playing the piano, the depression of the keys will result in the closing of corresponding normally open switches 15*a*–15*n*. When the key is released, the switches 15*a*–15*n* will then be returned to their open state.

Figure 3:
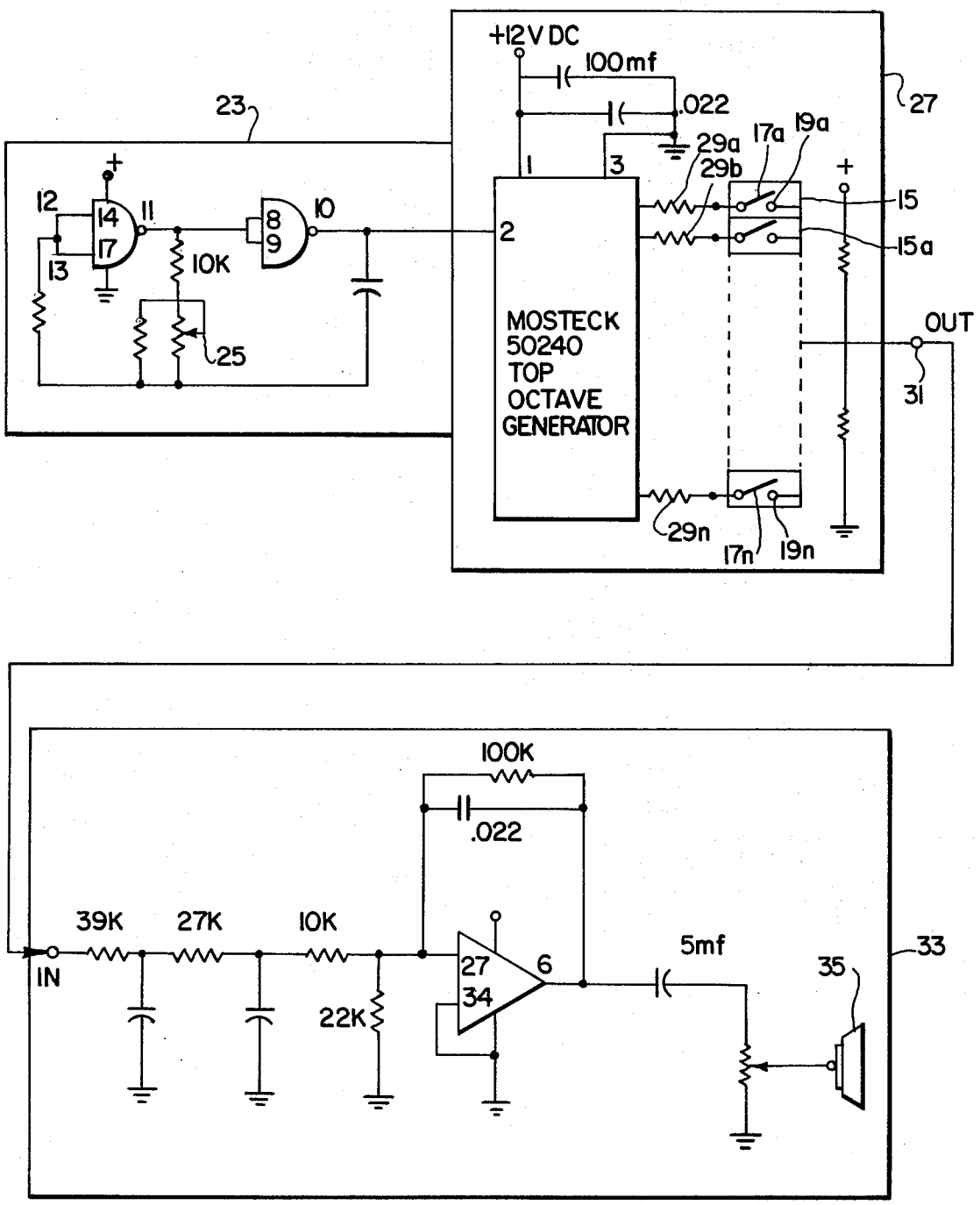
FIG. 3 is a schematic diagram of the bass-tone generator of the present invention.

FIG. 3 is a schematic diagram of the bass-tone generator circuit of the present invention. The circuit comprises a clock oscillator 23 which generates a basic frequency between 27 Khz and 34 Khz. The frequency of the clock oscillator is varied by means of variable resistor 25. Resistor 25 is used to vary the pitch so that the bass-tone device of the present invention can be tuned in accordance with the particular piano with which it is being used.

The output of the clock oscillator 23 is applied to a frequency divider 27. The frequency divider includes an octave generator, such as a Mosteck 50240, which has a plurality of outputs. The outputs are coupled to switches 15*a*–15*n* through resistors 29*a*–29*n*. As can be seen, when a particular key 5*a*–5*n* on the piano is depressed, the corresponding contacts 17*a*–17*n* will make contact with contacts 19*a*–19*n* of the corresponding switches 15*a*–15*n*, thereby producing an output at output terminal 31 of the frequency divider 27. The output of the frequency divider is applied to filter circuit 33 which produces an output of a bass-tone which corresponds to a depressed key of piano keyboard 5.

The output of the filter circuit 33 is applied to an amplifier and speaker 35 for generating a corresponding bass-tone.

The bass-tone device of the present invention may be mounted on a piano by any appropriate means such as a bracket, adhesives or adhesive tape, screws or bolts, etc.

The present invention may be embodied in other specific forms without departing from the spirit or essential characteristics thereof. The presently disclosed embodiments are, therefore, to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A bass-tone device for use with a piano having a keyboard, said device comprising:

(a) a housing, for mounting on a piano above the keyboard thereof;

(b) a plurality of switch means mounted in said housing, each of said switch means having an engaging portion extending from said housing for contacting a key of the piano and for remaining in contact with the key for at least a portion of the movement thereof, wherein when a key is depressed, the engaging portion of the switch means in contact therewith, moves, thereby changing the state of said switch means; and (c) bass-tone generator means mounted in said housing and having said switch means connected thereto, said bass-tone generator means generating bass-tone signals in response to the change of state of said switch means.

2. A bass-tone device as set forth in claim 1, wherein said engaging portion of each of said switch means comprises a pin member extending from said housing and contacting the top surface of a piano key positioned thereunder.

3. A bass-tone device as set forth in claims 1 or 2, wherein each of said switch means includes a pair of electrical contacts and said engaging portion of each of said switch means is connected to one of the electrical contacts of said switch means such that the movement of said engaging portion moves said one contact with respect to the other of said contacts wherein electrical contact between said contacts changes in response to the movement of said engaging portion.

4. A bass-tone device as set forth in claim 1, wherein said bass-tone generator means includes tuning means for changing the pitch thereof.

5. A base-tone device as set forth in claim 4, wherein said bass-tone generator means comprises:

(a) oscillator means for providing a signal of a predetermined frequency, said tuning means being connected to said oscillator means for varying the predetermined frequency thereof; and (b) frequency divider means coupled to the output of said oscillator means for frequency dividing the output thereof into a plurality of frequencies, said frequency divider means having a plurality of output means, each of said frequencies having a different output, wherein each of said switch means is coupled to one of said output means such that at least one of said output means provides an output in response to the change of state of a corresponding one of said switch means.

* * * * *